US008127972B2

(12) United States Patent
Hanse et al.

(10) Patent No.: US 8,127,972 B2
(45) Date of Patent: Mar. 6, 2012

(54) POURING NOZZLE, PUSHING DEVICE FOR A POURING NOZZLE AND CASTING INSTALLATION

(75) Inventors: Eric Hanse, Feignles (FR); Stéphane Taburiaux, Seneffe (BE)

(73) Assignee: Vesuvius Crucible Company, Wilmington, DE (US)

( * ) Notice: Subject to any disclaimer, the term of this patent is extended or adjusted under 35 U.S.C. 154(b) by 520 days.

(21) Appl. No.: 10/542,698

(22) PCT Filed: Jan. 19, 2004

(86) PCT No.: PCT/BE2004/000010

§ 371 (c)(1),
(2), (4) Date: Jul. 19, 2005

(87) PCT Pub. No.: WO2004/065041

PCT Pub. Date: Aug. 5, 2004

(65) Prior Publication Data

US 2006/0049555 A1 Mar. 9, 2006

(30) Foreign Application Priority Data

Jan. 20, 2003 (EP) ..... 03447014

(51) Int. Cl.
*B22D 35/04* (2006.01)

(52) U.S. Cl. ..... 222/606

(58) Field of Classification Search ..... 222/606
See application file for complete search history.

(56) References Cited

U.S. PATENT DOCUMENTS

| | | | | |
|---|---|---|---|---|
| 4,182,466 | A | 1/1980 | Fehling et al. | |
| 4,669,528 | A | 6/1987 | Szadkowski | |
| 4,951,851 | A | 8/1990 | King et al. | |
| 4,995,535 | A | 2/1991 | Ooya et al. | |
| 5,044,533 | A * | 9/1991 | King | 222/606 |
| 5,170,915 | A | 12/1992 | Szadkowski | |
| 5,188,743 | A | 2/1993 | King | |
| 5,688,425 | A | 11/1997 | Yamamoto et al. | |
| 6,533,147 | B1 | 3/2003 | Boisdequin | |
| 6,681,964 | B2 * | 1/2004 | Renard et al. | 222/606 |
| 6,772,922 | B2 | 8/2004 | Renard et al. | |

FOREIGN PATENT DOCUMENTS

| | | | |
|---|---|---|---|
| CH | 664334 | | 7/1988 |
| CN | 1008150 | B | 4/1987 |
| CN | 2242745 | Y | 12/1996 |
| CN | 2487471 | Y | 4/2002 |
| CN | 1247351 | | 3/2006 |
| DE | 2727742 | A1 | 1/1978 |
| EP | 80672 | B1 | 8/1983 |
| EP | 192019 | A1 | 8/1986 |
| EP | 441927 | A1 | 3/1991 |
| EP | 0718058 | A1 | 6/1996 |
| EP | 1133373 | A1 | 6/2000 |
| GB | 1593372 | | 7/1981 |
| WO | 92/05901 | | 4/1992 |
| WO | WO 00/35614 | A1 | 6/2000 |
| WO | 01/81028 | A1 | 11/2001 |

* cited by examiner

*Primary Examiner* — Jessee R. Roe

(74) *Attorney, Agent, or Firm* — Thomas Clinton; Donald M. Satina

(57) ABSTRACT

A pouring nozzle for a device for nozzle insertion and/or removal has a shape that is adapted so as to better resist the stresses imposed by their use and notably the stresses linked to the maintenance of the nozzle in the device. The pouring nozzle is provided with two exposed bearing faces forming with the pouring channel an angle β of 20° to 80°. A pushing device applies thrust force to the nozzle. A casting installation embodies the nozzle and the pushing device.

10 Claims, 2 Drawing Sheets

POURING NOZZLE, PUSHING DEVICE FOR A POURING NOZZLE AND CASTING INSTALLATION

CROSS-REFERENCE TO RELATED APPLICATIONS

This application claims the benefit of priority under 35 USC 365(c) of International Application PCT/BE04/00010, filed Jan. 19, 2004.

STATEMENT REGARDING FEDERALLY SPONSORED RESEARCH OR DEVELOPMENT

Not Applicable

THE NAMES OF PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION (1) Field of the Invention

The present invention relates to a pouring nozzle for the transfer of molten metal from an upper metallurgical vessel to a lower metallurgical vessel. In particular, it concerns a pouring nozzle of refractory material for the transfer of molten steel from a tundish to an ingot mold or, alternatively, from a casting ladle to a tundish.

(2) Description of the Related Art

The pouring nozzles intended for transferring molten metal from a metallurgical vessel to another while protecting the metal against chemical attacks and isolating it thermally from the surrounding atmosphere are wear elements which are strongly stressed to an extent that their service life can limit the casting time. Devices for the nozzle insertion and/or removal recently described in the state of the art have permitted to solve this problem (see for example European patents 192,019 and 441,927). For example, as soon as the nozzle external wall erosion at the vicinity of the meniscus reaches a certain level, the worn nozzle is exchanged with a new nozzle in a period of time sufficiently short for not having to interrupt the casting.

Generally in these devices, one will use a pouring nozzle constituted of a tubular part defining a pouring channel and, at its upper end, of a plate provided with an orifice defining a pouring channel, said plate comprising an upper surface contacting the upstream element of the pouring channel and a lower surface forming the interface with the lower part of the nozzle, said lower surface comprising two planar bearing surfaces located on both sides of the pouring channel.

The nozzle is intended to slide in guides against the planar lower surface either of a pouring orifice such as an inner nozzle, of a bottom plate affixed to such a pouring orifice or of a fixed plate affixed to a casting flow control device inserted between the pouring orifice (inner nozzle for example) and the pouring nozzle. It must be clear that in the context of the present invention, when reference is made to a pouring nozzle, this nozzle intended to slide in a device and is not a fixed nozzle such as an inner nozzle.

Known devices and particularly the device disclosed in the document EP 192,019, have a pouring nozzle sliding into guides able to transmit a thrust force upwardly (pushing device). This thrust force is obtained by springs arranged at a certain distance of the pouring orifice and actuating levers or rockers. These transmit the thrust force to the planar surfaces of the pouring nozzle plate. This upwardly directed thrust force pushes relatively tightly the pouring nozzle plate against the upstream refractory element, notably an inner nozzle or a refractory plate.

Pouring nozzles can be mono-block or can be constituted of an assembly of several refractory elements.

In most of the cases, the lower surface of the plate and the upper end of the tubular part of the nozzle are protected by a metallic can.

It has however often been noted that cracks or micro-cracks can appear at the level of the junction between the tubular element and the plate, located at the upper end of the tubular element. These cracks can occur when the nozzle is serviced or during its use. The origin of the cracking can be an excess of thermal stresses, of mechanical stresses or of thermo-mechanical stresses. These stresses are generated by the forces exerted to maintain the nozzle in the device, by vibrations and by the liquid metal flow.

In certain cases, these cracks induce the rupture of the element. In other cases, even though these cracks have a tiny size, it is necessary to take them into account. The throttling generated by the flow of liquid metal in the nozzle creates indeed a low pressure and, consequently, induces an important aspiration of the ambient air. The atmospheric oxygen and even nitrogen are important contamination sources for the liquid metal, in particular of steel. Further, under the combined action of the oxygen and of the very high temperatures, the refractory material can considerably deteriorate at the oxygen entry level, i.e. at the crack level. This deterioration increases the local deterioration of the refractory material and widens the crack to such an extent that it can be necessary to stop the casting.

There are several means provided in the state of the art to increase the resistance of the nozzle against cracking.

Refractory materials having a better resistance to cracking are known. Nevertheless, these materials are generally sensitive to other phenomenon such as erosion or corrosion.

Another solution disclosed in the document WO 00/35614 is the use of a metallic can reinforced at its lower part by mechanical means which increase its stiffness.

The document EP 1,133,373 describes a nozzle comprising a shock-absorbent intermediate region between the metallic can and the refractory nozzle. This region is comprised of a material whose thermal properties are such that it remains solid at ambient temperatures but is subjected to deformation at high temperatures. This buffer region reduces the risks of formation of cracks or micro-cracks generated by the thermo-mechanical stresses appearing at the beginning of the casting.

Despite the advantages brought to the art by the above described solutions and their continuous improvements during these last years, there are still some problems.

Indeed, in the known devices for the nozzle insertion and/or removal, the plate is always subjected to important flexural stresses which can be responsible for the formation of cracks at the upper end of the tubular part. It has indeed been observed that the upper plate can deform by flexion around an axis parallel to the direction of the guides where the said plate slides.

The above described solutions permit to lower these flexural stresses by stopping them or by diluting them and this, by acting on the material itself or on the nozzle assembly techniques. These solutions are expensive and not fully satisfactory.

BRIEF SUMMARY OF THE INVENTION

The present invention has for an object a pouring nozzle whose shape is adapted to better resist the stresses imposed by its use and notably the stresses linked to maintaining the nozzle in the device.

The nozzle has also a shape adapted to receive a pushing device which generates a favourable stress pattern.

In particular, the present invention relates to a pouring nozzle for a nozzle insertion and or removal device, wherein the nozzle is constituted of a tubular part defining a pouring channel and, at its upper end, of a plate provided with an orifice defining a pouring channel, said plate comprising an upper surface contacting the upstream element of the pouring channel and a lower surface forming the interface with the tubular part of said nozzle; said plate comprising two exterior planar bearing surfaces located on the opposite side of the upper surface of the plate and located on both sides of the pouring channel. This nozzle is characterized in that said two surfaces form with the pouring channel axis an angle β of 20° to 80°. The tubular part can have a generally cylindrical, oval or conical shape. The plate is preferably a square or a rectangle.

The shape of the plate according to the invention permits to improve the resistance to cracking and this without having to increase the quantity of matter in the region sensitive to cracks. Thereby, the hindering dimensions remain substantially identical to these of the prior art nozzles.

When the nozzle of the invention is introduced into an insertion and or removal device, the said two bearing surfaces are parallel to the firing direction of the nozzle.

It has been observed that an angle .beta. of 30.degree. to 60.degree., and, in particular an angle of about 45.degree., gives good results as to the cracking resistance and the stress pattern. The traction stress measured in a pouring nozzle at the level of the critical region for an angle of 45.degree. are lower by 40 to 50% to these that can be observed for an angle of 90.degree. corresponding to the state of the art.

According to a particular embodiment of the invention, the plate of the nozzle is asymmetrical with respect to the plane perpendicular to the bearing surfaces of the nozzle plate and comprising the pouring channel axis. Thereby, the useful surface of the plate on both sides of this plane is different. This enables to insert a nozzle into two positions, one casting position wherein the orifice of the plate corresponds to the upstream pouring channel and an intermediate position wherein the orifice of the plate does not communicate with the upstream pouring channel in order to obstruct it. This can be useful when the upstream closure system ensured for example by a stopper is defective. It permits also to avoid using a safety plate since the closure can be ensured by the nozzle plate itself.

The shape of the nozzle according to the invention enables also the use of a pushing device which is different from the ones used in the art.

The present invention relates thus also to a pouring nozzle for a nozzle insertion and removal device. The pushing device according to the invention is characterized in that the resulting thrust force is applied according to a direction forming an angle .alpha. of 10.degree. to 70.degree. with the pouring channel axis.

The pushing device applies a thrust force on the pouring nozzle bearing surfaces which is not upwardly directed parallel to the pouring channel axis as in the existing devices, but obliquely with respect to it and directed towards the pouring channel.

The flexural stresses in the pouring nozzle generated by such a device are lower than the ones of the prior art devices. The resulting thrust force comprises a vertical component which ensure the tightness with the upstream element and an horizontal component. This horizontal component is favourable since it induces that the refractory material is under compression, allowing thereby a reduction of the cracks generation and/or of their spreading.

The resulting thrust force of the pushing device according to the invention must be applied with an angle CL of 10.degree. to 70.degree. Indeed, an angle of less than 10.degree. corresponds to applying a virtually vertical force as in the known devices and has no significant positive impact on the cracking phenomenon. When the force is applied with an angle higher than 70.degree., then the vertical component of the force is no longer sufficient to ensure a good contact and a good tightness between the nozzle plate and the upstream element.

It has been observed that a thrust angle .alpha. of 30.degree. to 60.degree., and in particular, an angle of about 45.degree. provides excellent results as to the cracking resistance and the stress pattern. The traction stresses measured in a pouring nozzle at the level of the critical region for a thrust angle of 45.degree. are of 40 to 50% lower than these measured for a thrust angle of 90.degree. corresponding to the state of the art. An angle of 45.degree. is a good compromise between the vertical component of the thrust force which ensures the tightness and the horizontal component. Indeed, a minimum vertical component is required to enable a tight contact between the nozzle and the upstream element. The more the angle .alpha. increases, the more the thrust force must increase to ensure the same vertical component. Too high a thrust force can generate mechanical problems which are not negligible, notably an increased demand on the springs and a reduction of their life time.

An angle of 45.degree. permits also an easy manufacture of the pouring nozzle and of the pushing device.

The thrust force can be applied directly on the bearing surface of the pouring nozzle plate, for example by springs or through the intermediate of an element such as a rocker.

Another aspect of the invention relates to a casting installation comprising a nozzle insertion and exchange device, comprising a pouring nozzle according to the invention.

The pouring nozzle is maintained in tight contact with the upstream casting element by the pushing device. The thrust force of the pushing device being applied on both planar bearing surfaces of the pouring nozzle plate. The casting installation comprises also a rail-guide system able to receive the two bearing surfaces of the pouring nozzle and enabling to insert a new pouring nozzle into the casting position and to expel the worn pouring nozzle beyond the casting position.

The rail-guide system presents a bearing surface whose the angle forms with the pouring axis an angle substantially equal to the angle .beta. formed by the bearing surfaces of the pouring nozzle plate with said pouring axis.

BRIEF DESCRIPTION OF THE SEVERAL VIEWS OF THE DRAWINGS

In order to enable a better understanding of the invention, it will now be described with reference to the figures illustrating particular embodiments of the invention, without however limiting the invention in any way.

On these figures, it has been shown on FIG. 1, a pouring nozzle according to the state of the art and the resulting vertical thrust force applied to the planar bearing surfaces.

DETAILED DESCRIPTION OF THE INVENTION

Figure 1:
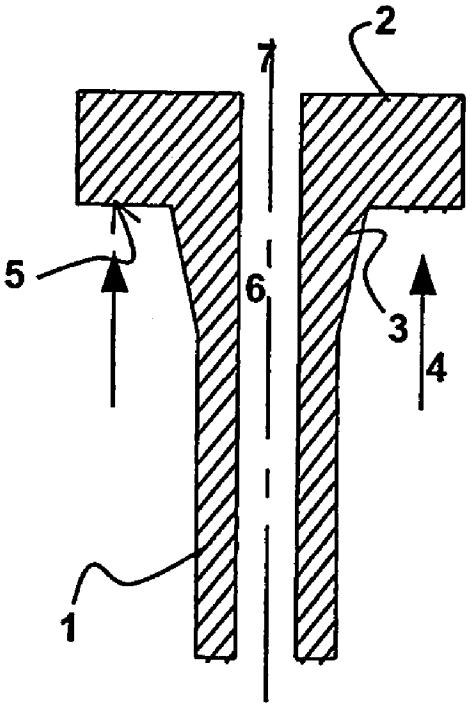
Fig. 1 Prior Art

FIG. 1 shows a pouring nozzle (1) of the state of the art comprising a plate (2) and a tubular part (3). The planar bearing surfaces (5) form an angle .beta. of 90.degree. with the pouring channel axis (7). The thrust force (4) is vertical, parallel to the pouring channel axis (7). The stresses generated in the pouring nozzle of the prior art can be responsible for the formation of cracks at the upper end of the tubular part (3).

Figure 3:
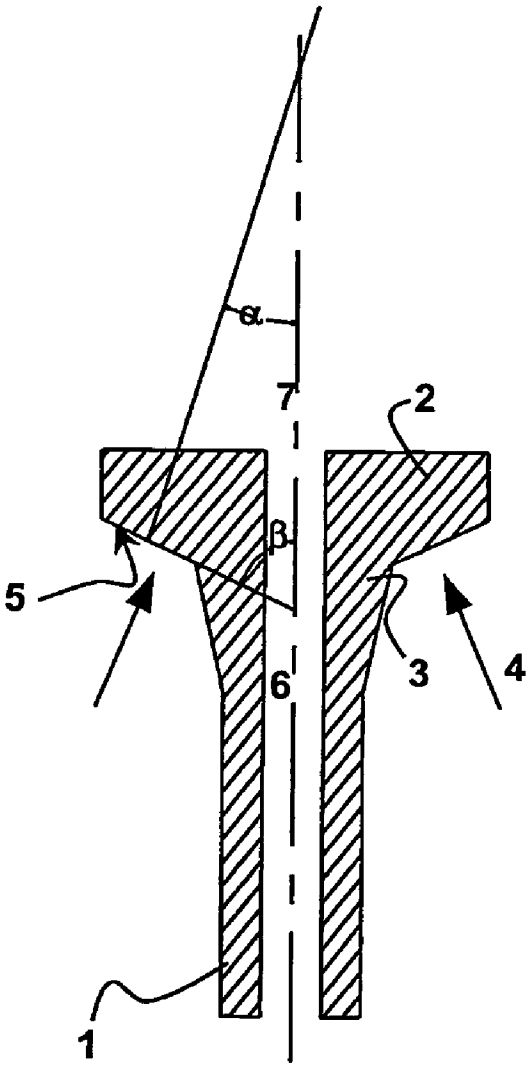
FIG. 3 shows a pouring nozzle according to the invention, the angles .alpha. and .beta. represents respectively the angle formed by the resulting thrust force with the pouring channel axis and the angle formed by the planar bearing surface with the pouring channel axis.
Figure 2:
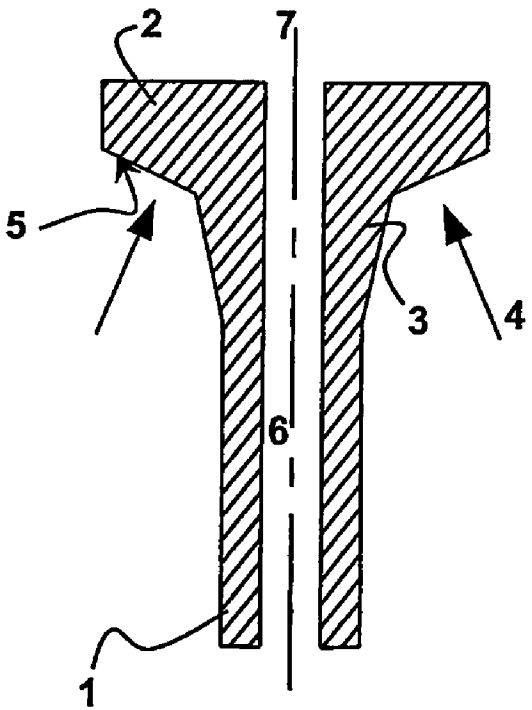
FIG. 2 depicts a pouring nozzle according to the invention and the resulting thrust force applied to the planar bearing surfaces.

FIGS. 2 and 3 show a pouring nozzle (1) according to the invention. The plate (2) of the pouring nozzle (1) is in a certain manner truncated. The planar bearing surfaces (5) form an angle .beta. of 20.degree. to 80.degree. and this, without requiring to increase the quantity of matter of the plate (2).

FIG. 3 shows the angles .alpha. and .beta. The resulting thrust force and the pouring channel axis form an angle .alpha. of 21.degree. The planar bearing surfaces and the pouring channel axis form an angle .beta. of 69.degree.

Figure 4:
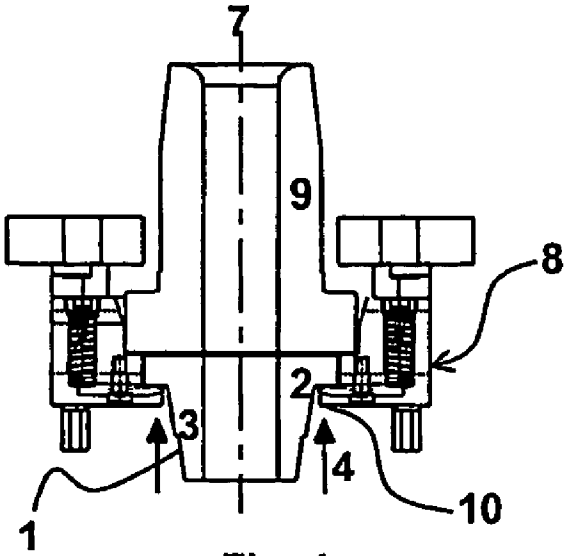
Fig. 4 Prior Art
FIG. 4 represents a pushing device according to the state of the art.

FIG. 4 shows a prior art pushing device (8). The resulting thrust force (4) is applied vertically, parallel to the pouring channel axis (7) through a rocker (10).

Figure 5:
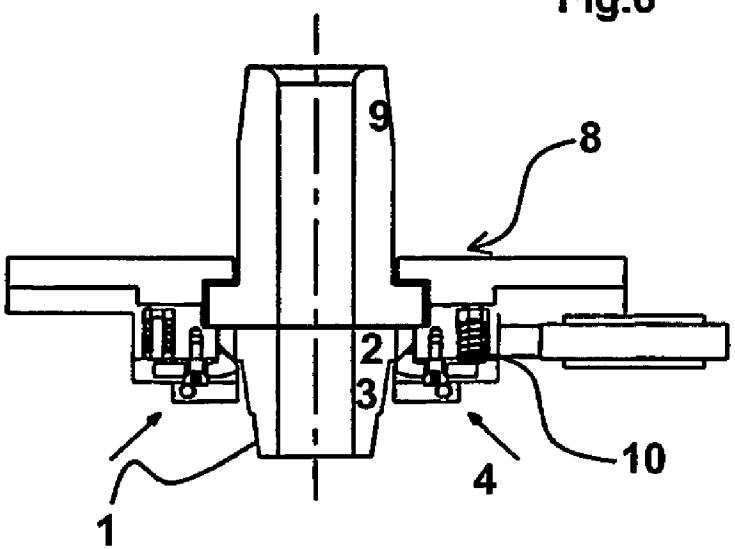

FIG. 5 shows a pushing device (8) according to the invention. The resulting thrust force (4) is applied through a rocker (10).

Figure 6:
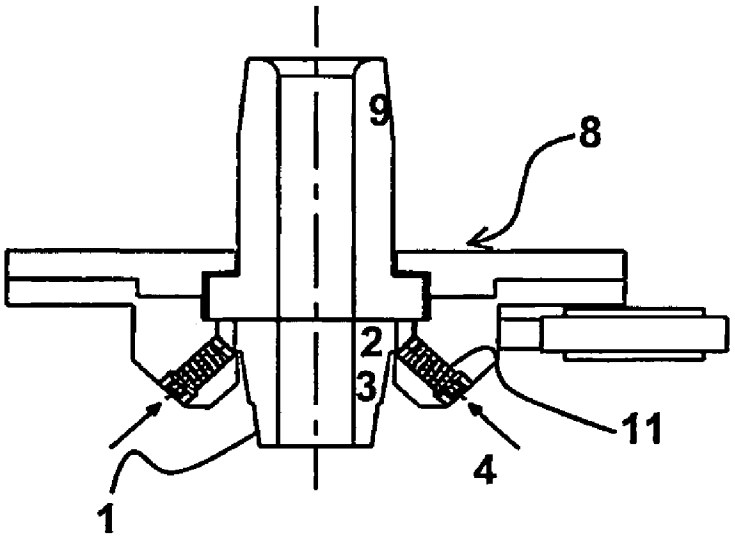
FIGS. 5 and 6 show embodiments of a pushing device according to the invention.

FIG. 6 shows a pushing device (8) according to the invention. The resulting thrust force (4) is applied directly to the bearing surfaces through springs (11).

REFERENCES

1. Pouring nozzle
2. Plate
3. Tubular part
4. Resulting thrust force
5. Planar bearing face
6. Pouring channel
7. Pouring axis
8. Pushing device
9. Inner nozzle
10. Rocker
11. Spring

SEQUENCE LISTING

Not Applicable

The invention claimed is:

1. Pouring nozzle for a nozzle insertion and or removal device, comprising a tubular part defining a pouring channel and, at its upper end, of a plate provided with an orifice defining a pouring channel, said plate comprising an upper surface contacting the upstream element of the pouring channel and a lower surface forming the interface with the upper part of the tubular part of the nozzle; said plate comprising two exposed exterior planar bearing surfaces located on opposite sides of the pouring channel and wherein said two bearing surfaces form with the pouring channel axis an angle β of 30° to 60°.

2. Pouring nozzle according to claim 1, wherein said two bearing surfaces are parallel to the nozzle firing direction.

3. Pouring nozzle according to claim 1, wherein said two surfaces form with the pouring channel axis an angle β of 35° to 55°.

4. Pouring nozzle according to claim 3, wherein said surfaces form with the pouring channel axis an angle β of about 45°.

5. Pouring nozzle according to claim 1, wherein the plate is asymmetrical with respect to the plane perpendicular to the bearing surfaces of the nozzle plate and comprising the pouring channel axis.

6. Insertion and removal device for a pouring nozzle having two exposed exterior planar bearing surfaces, comprising a pushing device wherein the resulting thrust force is applied in a direction forming with the pouring channel axis an angle α of 10° to 70° and a guiding device comprising a bearing surface able to receive a pouring nozzle bearing surface, forming with the pouring channel axis an angle β of 30° to 60°.

7. Device according to claim 6, wherein the resulting thrust force is applied in a direction forming with the pouring channel axis an angle α of 30° to 60°.

8. Device according to claim 6, wherein the resulting thrust force is applied in a direction forming with the pouring channel axis an angle α of about 45°.

9. Device according to claim 6, wherein the thrust force is applied directly against the bearing surface by springs.

10. A nozzle installation system comprising a) a pouring nozzle comprising a tubular part defining a pouring channel and, at its upper end, of a plate provided with an orifice defining a pouring channel, said plate comprising an upper surface contacting the upstream element of the pouring channel and a lower surface forming the interface with the upper part of the tubular part of the nozzle; said plate comprising two exposed exterior planar bearing surfaces located on opposite sides of the pouring channel and wherein said two bearing surfaces form with the pouring channel axis an angle β of 30° to 60°; and b) an installation device comprising a pushing device wherein the resulting thrust force is applied in a direction forming with the pouring channel axis an angle α of 10° to 70° and a guiding device comprising a bearing surface, able to receive a pouring nozzle bearing surface, forming with the pouring channel axis an angle β of 30° to 60°.

* * * * *